US007549921B2

(12) United States Patent
Storm

(10) Patent No.: US 7,549,921 B2
(45) Date of Patent: Jun. 23, 2009

(54) GAME PLAYER SELECTION DEVICE AND METHOD

(75) Inventor: Timothy C. Storm, 6540 Yale Bridge Rd., Rockton, IL (US) 61072

(73) Assignee: Timothy C. Storm, Rockton, IL (US)

( * ) Notice: Subject to any disclaimer, the term of this patent is extended or adjusted under 35 U.S.C. 154(b) by 400 days.

(21) Appl. No.: 11/426,362

(22) Filed: Jun. 26, 2006

(65) Prior Publication Data

US 2007/0296145 A1 Dec. 27, 2007

(51) Int. Cl.
*A63F 13/10* (2006.01)

(52) U.S. Cl. ..... 463/22; 273/138.2; 273/138.1; 273/141 R; 273/141 A; 273/148 R

(58) Field of Classification Search ..... 463/22; 273/138.2, 138.1, 141 R, 141 A, 142 R, 146, 273/148 R See application file for complete search history.

(56) References Cited

U.S. PATENT DOCUMENTS 4,285,517 A * 8/1981 Morrison ..... 463/9
4,363,482 A * 12/1982 Goldfarb ..... 463/9
4,842,276 A * 6/1989 Darby ..... 463/22
5,158,301 A 10/1992 Martukovich, Jr.
5,743,796 A 4/1998 Orak et al.
5,918,881 A * 7/1999 Kirby ..... 273/146
6,926,274 B1 * 8/2005 Portella ..... 273/141 R
6,929,264 B2 8/2005 Huard et al.
2006/0108736 A1 5/2006 Walker et al.

* cited by examiner

*Primary Examiner*—Benjamin H Layno
(74) *Attorney, Agent, or Firm*—Reinhart Boerner Van Malderen P.C.

(57) ABSTRACT

A game player selection device for indicating a turn in a multiple player game is provided. The game player selection device includes a housing, a selector, a number of indicators, and a control circuit. The selector is disposed on the housing and is used to select one of the operating modes. The operating modes include sequential, random and random but fair. The indicators are dispersed on the housing. The control circuit is coupled to the selector and the plurality of indicators. The control circuit temporarily activates at least one of the indicators based on the selected operating mode. As such, the turn in the multiple player game is indicated.

20 Claims, 3 Drawing Sheets

GAME PLAYER SELECTION DEVICE AND METHOD

FIELD OF THE INVENTION

This invention generally relates to multiple player games and, in particular, to mechanisms and methods for determining an order of play for the multiple player games.

BACKGROUND OF THE INVENTION

Games such as, for example, board games are often played by families, groups of friends, and the like, for the purpose of entertainment. Because numerous players are often simultaneously involved in these games, each player is typically given their own individual and exclusive opportunity or amount of time in which to take a "turn" or make a "move" (i.e., actively participate in the game). Depending on the particular game, the order of turns or moves takes place in either a sequential or random fashion.

Unfortunately, in those games that use a sequential order of game play, the need to keep track of which player has the current turn can be a distraction. Instead of enjoying the game, one or more of the players is forced to monitor the order of game play. If that player is not diligent in their duty and/or fails to continuously advise the other players as to the present order of game play, the question "Whose turn is it?" is likely to be frequently and undesirably asked throughout the course of the game.

In addition, in those games that suggest a sequential order of play, the lack of randomness or deviation from the scheduled order of turns can, after some time, cause the players to lose interest in the game. The game may simply become too monotonous after an extended period of time or after having been played too many times in a row. As a result, the players may decide not to continue with an existing game or decide not to start a new game after the previous game has concluded.

In contrast to games with a sequential order of play, other games rely upon a random order of turns or moves to generate excitement during game play. During such games, the order of game play is often decided entirely by chance (e.g., by a roll of one or more dice, by a spin of a wheel, etc.). Because the order of turns is so unpredictable, players are left guessing, forced to make a variety of tough decisions, thrown into wild or odd predicaments, and the like. To maximize such results and the entertainment provided by the game, the generation of a random order of turns is encouraged.

Unfortunately, in at least a few of the games that rely on methods of randomly deciding turns, the game can become unfair should one player end up with a disproportionate number of turns in a given time period. The inequity of awarding turns in such a random fashion or manner can be unpalatable to those players who enjoy some randomness, but still desire a game that is generally conducted or orchestrated fairly.

Therefore, a device that can selectively choreograph the order of turns for multiple player games would be desirable. The invention provides such a device. These and other advantages of the invention, as well as additional inventive features, will be apparent from the description of the invention provided herein.

BRIEF SUMMARY OF THE INVENTION

The invention provides a device that selectively produces either a sequential, random, or random but fair order of turns for use during a multiple player game. The device also conveniently visually indicates which player is presently provided with an opportunity to move or take a turn. Therefore, all of the players are continuously appraised of the particular player who is actively participating or supposed to be actively participating in the game.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
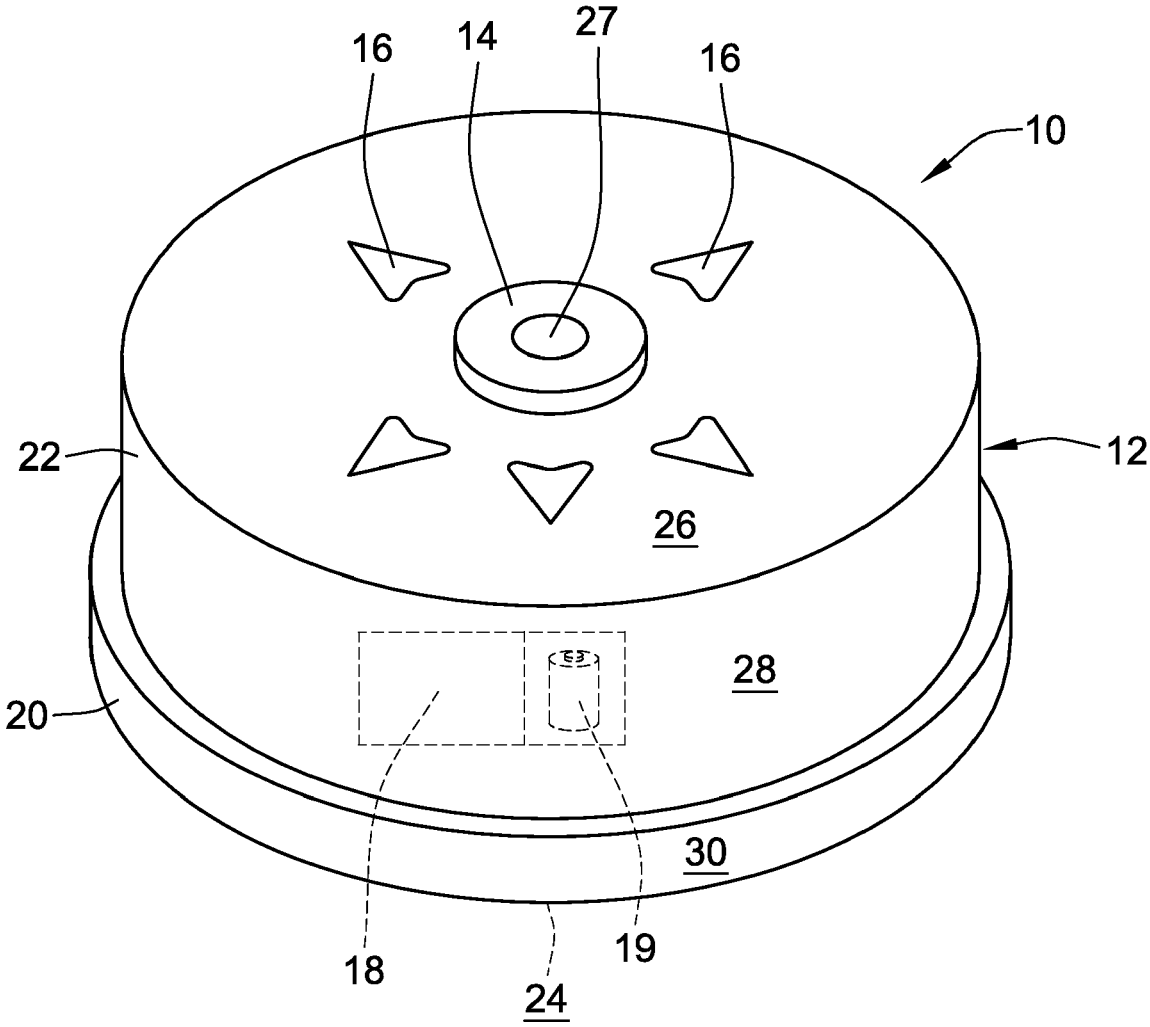
FIG. 1 is a top and front perspective view of an exemplary embodiment of a game player selection device constructed in accordance with the teachings of the present invention.

Referring to FIG. 1, an embodiment of a game player selection device 10 for identifying a current or present player in a multiple player game (e.g., a board game, card game, etc.) constructed in accordance with the teachings of the present invention is illustrated. The game player selection device 10 includes a housing 12, a selector 14, a plurality of indicators 16, and a control circuit 18. The housing 12 is generally formed from one or a combination of suitable materials such as, for example, plastic, metal, wood, and the like. The housing 12 is configured to hold, protect, and/or mount the selector 14, the indicators 16, and the control circuit 18.

As shown, the housing 12 includes a base portion 20 and a top portion 22. The base and top portions 20, 22 can be integrally formed with each other or can be separate components that are operatively coupled together. Where the base and top portions 20, 22 are distinct pieces, they can be disengaged to provide access to the control circuit 18 therein, to provide access to a battery 19 powering the game player selection device 10, and the like.

Figure 2:
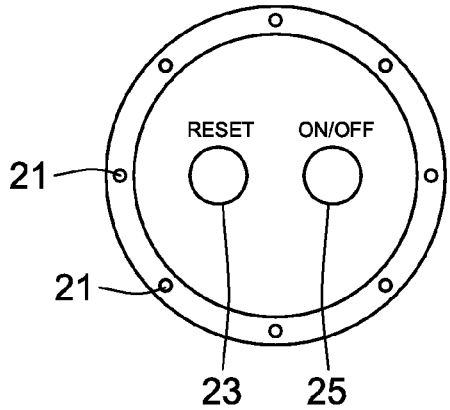
FIG. 2 is a bottom plan view of the game player selection device of FIG. 1.

The base portion 20 is configured such that the game selection device will rest securely on a surface such as, for example, a game board, a table, and the like. In that regard, and as shown in FIG. 1, the base portion 20 has a generally planar or flat bottom surface 24. As illustrated in FIG. 2, to ensure that the bottom surface 24 mates well with the surface supporting the game player selection device 10, the bottom surface can be outfitted with one or more traction-providing members or materials 21 such as, for example, rubber protrusions, Velcro®, and the like. While illustrated in circular form in FIG. 1, the base portion 20 can also be square, triangular, oval, and the like. In one embodiment, a diameter (or dimension if the base portion is not circular) of the base portion 24 is greater than the diameter (or dimension) of the top portion 22.

Referring again to FIG. 2, in one embodiment the base portion 20 of the housing 12 includes a reset switch 23 and an on/off switch 25. The reset switch permits the game player selection device 10 to reset and/or be restarted. The on/off switch 25 permits the game player selection device 10 to be toggled between states of activation and deactivation. The reset and on/off switches 23, 25 can be depressible, linearly moveable, or other types of switches. Despite the reset and on/off switches 23, 25 being shown on the base portion 20 of the housing 12 in the illustrated embodiment, the switches can also be disposed elsewhere on the game player selection device 10 in other embodiments. Further, the reset switch 23 is optional in one embodiment.

Referring back to FIG. 1, the top portion 22 of the housing 12 is generally cylindrical and defines a generally planar top surface 26. As depicted, the top surface 26 accommodates the selector 14 and the plurality of indicators 16. The selector 14 is a device or feature such as a depressible button, a rotatable knob, a switch, and the like permitting one of several available operating modes to be selected. The available modes that can be chosen using the selector 14 include, for example, a sequential mode, a random mode, and a random but fair mode as will be explained more fully below. The selector 14 can include an activation indicator 27 such as, for example, a light emitting diode (LED). The activation indicator 27 is illuminated, either continually or temporarily, by the control circuit 18 when the game play selection device 10 is turned "on" and is not illuminated when the game player selection device is turned "off." Despite the selector 14 being shown on the top surface 26 of the housing 12, the selector can also be disposed elsewhere on the game player selection device 10.

Still referring to FIG. 1, the indicators 16 are electronic components and/or mechanical devices that are generally able to provide an indication regarding the order of game play. In other words, the indicators 16 are able to advise the collective group of players which particular player is scheduled for the current "turn" and/or "move" in the game. In one embodiment, with or without manipulating the game player selection device 10, the indicators 16 are also able to notify the group which player went last, which player is scheduled to go next, and so on.

To provide their indication, the indicators 16 can, for example, individually illuminate, produce sound, and/or move relative to the top surface 26 (e.g., raise or lower). Therefore, a visual, audible, and/or physical alert or message is provided and easily conveyed to the players of the game. In one embodiment, the indicators 16 are equally dispersed over the top surface 26 and are situated radially outwardly of the selector device 14. Further, the indicators 16 are each formed in the shape of a radially outwardly pointing arrow, triangle, or other similar shape capable of providing a directional reference. Therefore, for example, when one of the indicators 16 is lighted, the indicator "points" to a specific player who happens to be seated in that direction. The illustrated embodiment is particularly useful when the players are seated around a table or game board. Other embodiments configure the indicators 16 in arrangements corresponding to the particular type of game to which it is to be used. For example, the indicators 16 may be arranged in an arc corresponding to the players' typical seating arrangement for the game of Blackjack.

In one embodiment, the indicators 16 are high-intensity light-emitting diodes (LED's), bulbs, or some other light-producing device. The indicators 16 can be assigned and/or provided with one or more of a variety of different colors to distinguish each of the indicators from the others. For example, colored LED's and/or colored lenses can be employed. Also, while eight indicators 16 are shown in FIG. 1, more or fewer of the indicators can be provided. Further, if the game is played in teams of two, three, and the like, more than one indicator 16 can be activated or illuminated at the same time to indicate the turn of the team.

Even thought the plurality of indicators 16 are illustrated on the top surface 16, the indicators can also be provided elsewhere on the housing 12. For instance, the indicators 16 can be placed on the sidewall surface 28 of the top portion 22, the sidewall surface 30 of the base portion 20, and the sidewalls 28, 30 and the top surface 16.

In one embodiment, the indicators 16 are depressible, operate by capacitive touch, or are otherwise manipulated in order to select the number of players participating in a game. For example, if three players are playing, three of the indicator lights can be depressed simultaneously or within a certain period of time. In one embodiment, the selector 14 can also be employed to choose the number of players who will be playing the game and/or the relative positions of those players around the game selection device 10 through a series of responses.

The control circuit 18, which is shown in simplified form in FIG. 1, is an electronic device and/or software suitable to permit operation of the game player selection device 10. In that regard, the control circuit 18 is one or more of a microcontroller, microprocessor, microcomputer, programmable logic device, analog circuit, program, and the like. The control circuit 18 can include, employ, and/or operate in conjunction with firmware, software, a memory (e.g., read only memory, random access memory, flash memory, etc.), a battery, a display, and other electronic components and/or related peripherals. In one embodiment, the control circuit 18 is a single integrated circuit.

The control circuit 18 is operatively coupled to the selector 14, the indicators 16, the battery 19, the reset switch 23, the on/off switch 25, and the activation indicator 27 using, for example, wiring. The control circuit 18 is able to process any information input into the game selection device 10 via the selector 14, the indicators 16, and the switches 23, 25. The control circuit 18 is also able to orchestrate the activation of the indicators 16 based on the particular mode that has been chosen.

In operation, and in one embodiment, when the game player selection device 10 is reset or activated with the switches 23, 25 or other mechanism, the game player selection device 10 enters the set up mode. During the set up mode, the activation indicator 27 begins flashing at a slow rate (e.g., once per second) and the indicators 16 are illuminated in sequence at the slow rate (e.g., one indicator every second). This slow rate of flashing indicates to the players using the game player selection device 10 that the sequential mode of play is the current mode. If the selector 14 is depressed, the activation indicator 27 begins flashing at a medium rate (e.g., twice per second) and the indicators 16 are illuminated in sequence at the medium rate (e.g., two indicators every second). This medium rate of flashing indicates to the players using the game player selection device 10 that the random mode of play is the current mode. If the selector 14 is depressed again, the activation indicator 27 begins flashing at a fast rate (e.g., four times per second) and the indicators 16 are illuminated in sequence at the fast rate (e.g., four indicators every second). This fast rate of flashing indicates to the players using the game player selection device 10 that the random but fair mode of play is the current mode. By further depressing the selector 14, the game player selection device 10 is returned to the slow rate of flashing and, correspondingly, the sequential mode. The selector 14 can be further manipulated to continue toggling through the various modes.

When the game player selection device 10 has been toggled to the desired mode of play, the device is removed from the set up mode by depressing one of the indicators 16. Thereafter, each of the other players depresses their own corresponding indicator 16 such that the number of players for the game is selected. For example, if four players will be playing a particular game, then those four players each depress an indicator 16, preferably one that points in their direction, to end the set up mode and advise the game player selection device how many players are present. Each of the already depressed indicators 16 can illuminate to advise that the particular indicator has been chosen. After each player has manipulated their respective indicator 16 (i.e., the indicator that points toward them), one of the players depresses the selector 14 to begin game play according to the particular mode that was chosen. In one embodiment, a timer or timing sequence is employed to terminate the process of depressing or choosing indicators 16.

If further players wish to be added during game play, the new player simply depresses one of the indicators 16 that has not already been selected by the current players and the new player is automatically added to the game being played. Regardless of the particular mode of game play, the electronic control circuit 18 makes the needed adjustments to incorporate the new player into the game. If current players wish to be removed or are forced out of the game during game play, the departing player simply depresses their respective indicator 16 and the departing player is automatically removed from the game being played. Regardless of the particular mode of game play, the electronic control circuit 18 makes the needed adjustments to delete the removed player from the game.

When the sequential operating mode is chosen, the control circuit 18 causes the player selected indicators 16 to consecutively illuminate. As arranged in FIG. 1, the consecutive illumination of indicators 16 will proceed around the top surface 26 of the gamer player selection device 10 in either a clockwise or counterclockwise direction. Since the indicators 16 point radially outwardly, as each successive indicator is lighted, the player sitting generally in front of that indicator is given their turn in the game.

When the current player has completed their turn, that player can, for example, depress the selector 14 or, in an alternate embodiment, depress the indicator 16 itself. When the selector 14 is depressed, the control circuit 18 is notified that the player has completed his or her turn and the lighted indicator is extinguished. Thereafter, the control circuit 18 illuminates the adjacent indicator (i.e., the next indicator in sequence). When the next sequential indicator is illuminated, the next player and the entire group are advised that the next player is now authorized to take a turn and/or make a move in the game. As the game continues, this process of temporarily activating indicators 16 in progressive fashion around the top surface 26 is repeated. Therefore, the game selection device 10 easily and efficiently keeps track of who has the current turn and immediately advises all players of who has the next turn when each turn is finished.

In one embodiment, neither the selector 14 or the indicators 16 are depressed or otherwise manipulated in order to progress from turn to turn. In such cases, the turns progress from player to player when a predetermined or selected period of time has expired. Such time periods are programmable into the control circuit 18, input by the players, and the like. The time limitation option is able to add further excitement and perhaps difficulty to game play. Also, in one embodiment, after one turn has been indicated but prior to the next turn being awarded, the indicators 16 flash on and off, light sequentially, randomly illuminate, and the like to indicate the that game player selection device 10 is "thinking" about the next turn to be given out. In one embodiment, the indicators 16 flash at, for example, an increasing rate as the current player's turn gets closer to expiring to warn the player of the soon to expire time limit.

When the random operating mode is selected, the player selected indicators 16 are randomly illuminated by the control circuit 18. After each player's turn is completed by depressing the selector 14, any one of the plurality of indicators can be illuminated, including the indicator that was most recently deactivated. In other words, during game play one of the players may get two or even more turns in a row. As those skilled in the art will recognize, one player may be awarded a disproportionately increased or decreased number of turns during any given period of time. Unlike the sequential operating mode, the random mode is meant to be completely unpredictable. As a result, the game selection device 10 can furnish a unique twist to many existing games, especially those requiring a fair amount of strategy to win.

Still further, when the random but fair mode is activated, the player selected indicators 16 are made to illuminate on a quasi-random or somewhat random basis. In particular, after a player has taken a turn and the indicator 16 has been turned off, that player's particular indicator is not illuminated again until each other player has also been given a turn during that "round" of play. By way of example, in a game with five players, after a first indicator 16 is turned on and the player takes his or her turn, that indicator is temporarily disabled by the control circuit 18. The control circuit 18 then randomly selects from the four remaining active indicators (i.e., the eligible indicators). After the next indicator is chosen and that player moves, that indicator is likewise eliminated from consideration and the control circuit 18 selects from the remaining three active indicators.

This elimination and random selection procedure continues until each indicator 16 has been randomly chosen once. Thereafter, all of the indicators 16 are reactivated for a new round of play and the random but fair process starts again. While the random aspect of this mode keeps the game exciting, this mode ensures that the game remains fair since each player receives one and only one turn before any player receives a second turn.

Figure 3A:
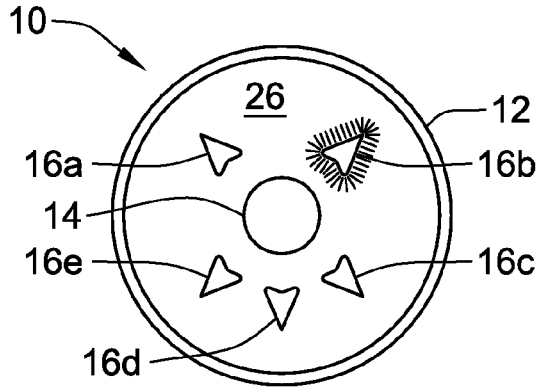
FIG. 3A-E is a series of views illustrating one example of a random but fair mode available with the game player selection device of FIG. 1.

An illustration of how one round of the above-noted random but fair play might occur is collectively illustrated in FIGS. 3A-E. Because only five players are playing the game, only five of the indicators, which are denoted 16*a-e*, are illustrated on the game player selection device 10. To begin, one of the indicators 16*a-e* is randomly selected. In this example, assume that the first randomly selected indicator happens to be indicator 16*b*. Because indicator 16*b* was chosen, that indicator is illuminated as illustrated in FIG. 3A and the corresponding player takes his turn. After that player has made his move, indicator 16*b* is extinguished and eliminated from possible further illumination during that round of play. As a result, only indicators 16*a* and 16*c-e* are available to be chosen.

Figure 3B:
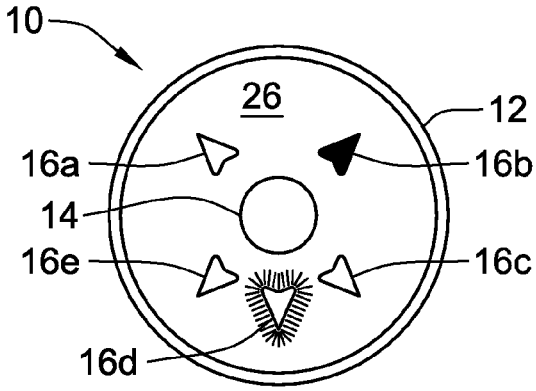

Moving on to FIG. 3B, since the indicator 16*b* was eliminated from consideration, that indicator is shown darkened. One of the remaining available indicators, namely 16*a* and 16*c-e*, is now randomly selected by the control circuit 18. Again, for the purposes of illustration, assume that the next selected indicator happens to be indicator 16*d*. Because indicator 16*d* was chosen, that indicator is illuminated as illustrated in FIG. 3B and the corresponding player takes his turn. After that player has made his move, indicator 16*d* is extinguished and eliminated from possible further illumination during that round of play along with indicator 16*b*. As a result, only indicators 16*a*, 16*c*, and 16*e* are available to be chosen.

Figure 3C:
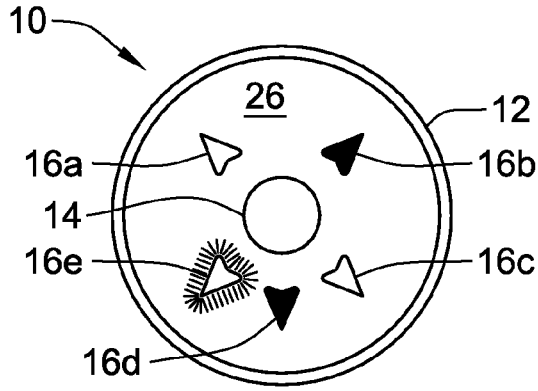

Continuing with FIG. 3C, since the indicators 16*b* and 16*d* were eliminated from consideration, those indicators are shown darkened. One of the remaining available indicators, namely 16*a*, 16*c*, and 16*e*, is now randomly selected by the control circuit 18. Again, for the purposes of illustration, assume that the next selected indicator happens to be indicator 16*e*. Because indicator 16*e* was chosen, that indicator is illuminated as illustrated in FIG. 3C and the corresponding player takes his turn. After that player has made his move, indicator 16*e* is extinguished and eliminated from possible further illumination during that round of play along with indicators 16*b* and 16*d*. As a result, only indicators 16*a* and 16*c* are available to be chosen.

Figure 3D:
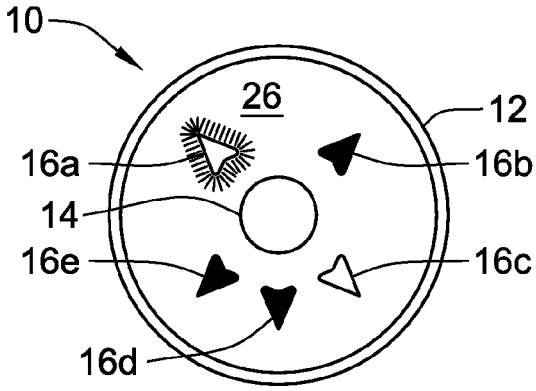

As shown in FIG. 3D, since the indicators 16*b* and 16*d-e* were eliminated from consideration, those indicators are shown darkened. One of the remaining available indicators, namely 16*a* and 16*c*, is now randomly selected by the control circuit 18. Again, for the purposes of illustration, assume that the next selected indicator happens to be indicator 16*a*. Because indicator 16*a* was chosen, that indicator is illuminated as illustrated in FIG. 3D and the corresponding player takes his turn. After that player has made his move, indicator 16*a* is extinguished and eliminated from possible further illumination during that round of play along with indicators 16*b* and 16*d-e*. As a result, only indicator 16*c* is available to be chosen.

Figure 3E:
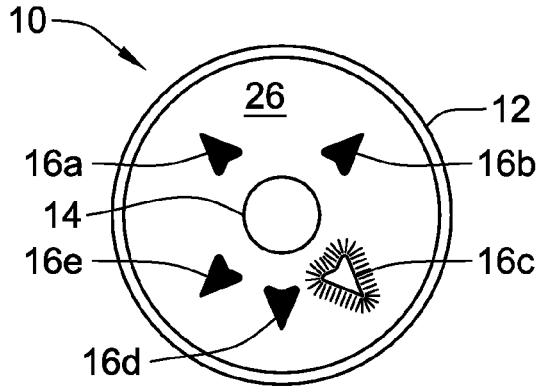

Finally, as shown in FIG. 3E, since the indicators 16*a-b* and 16*d-e* were eliminated from consideration, those indicators are shown darkened and the only available indicator 16*c* is chosen. Because indicator 16*c* was chosen, that indicator is illuminated as illustrated in FIG. 3E and the corresponding player takes his turn. After that player has made his move, all of the indicators 16*a-e* are reactivated and eligible to be chosen as game play continues in a new round. During this new round, one of the indicators 16*a-e* is randomly selected and then successively eliminated as described above. While the pattern of FIGS. 3A-E could possibly be immediately repeated, this is not probable because of the random selection process.

Figure 5:
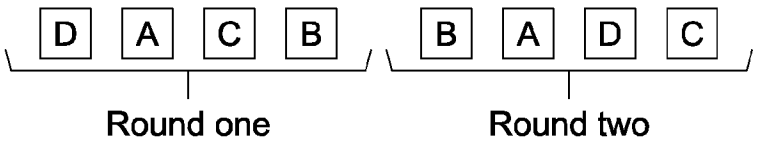
FIG. 5 is a simplified schematic of two consecutive turns possible for one particular player in the random but fair mode.
Figure 4:
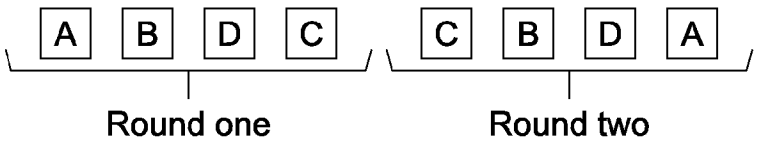
FIG. 4 is a simplified schematic of a maximum number of turns possible between the turns of one particular player in the random but fair mode.

As illustrated in FIG. 4, during the random but fair mode of game play when, for example, four players (A-D) are playing, the maximum number of turns (represented by the blocks) that one of the players might have to wait between their own turns is six. As shown, if player A is selected first in round one and then last in round two, six turns separate the turns of player A. If the number of players was increased to eight, then the maximum number of turns that one of the players might have to wait between their own turns increases to fourteen. Also, one player could be allowed two consecutive turns. As illustrated in FIG. 5, this would occur where one player, player B, is awarded the last turn in one round and then the first turn in the next round.

In another embodiment, the random but fair mode is modified such that the control circuit 18 considers more than one round of play when making random but fair selections. For example, if four players are selected and two rounds of game play are considered, then there are a total of eight turns initially available. From these eight turns, the control circuit 18 randomly awards individual turns to the players thereby permitting each player to have two of the eight turns. After a player has been given a turn, the control circuit 18 subtracts that turn from the two turns available for that player and subtracts one turn from the initial total of eight available turns. As such, the particular player still has one available turn and there are now seven turns yet to be randomly awarded. This process continues until the control circuit 18 has twice randomly awarded each player one turn thereby using up all eight of the initially available turns. Thereafter, the process is started over with a new set of eight possible turns.

Figure 6:
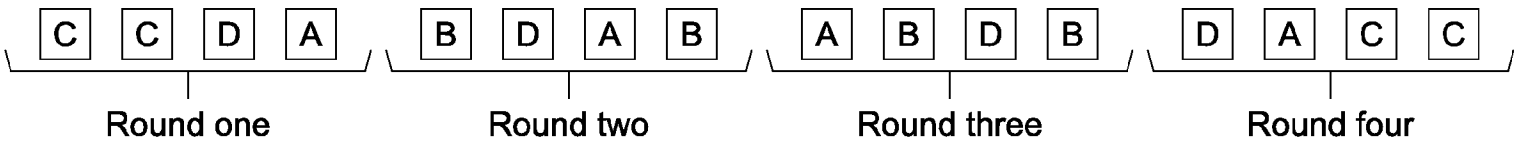
FIG. 6 is a simplified schematic of a maximum number of turns possible between the turns of one particular player in a modified random but fair mode.
Figure 7:
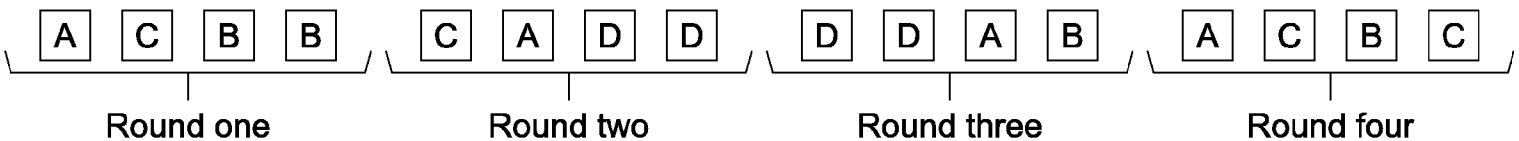
FIG. 7 is a simplified schematic of four consecutive turns possible for one particular player in the modified random but fair mode.

During the modified random but fair play, one player might have to wait up to twelve turns between his or her own turns as illustrated in FIG. 6. As shown, if player C is selected first and second in round one and then second to last and last in round four, twelve turns separate the turns of player C from the turns of players B-D. If the number of players was increased to eight, then the maximum number of turns that one of the players might have to wait between their own turns increases to twenty-eight. Also, one player could be allowed four consecutive turns. As illustrated in FIG. 7, this would occur where one player, player D, is awarded the last two turns in one set of two rounds (e.g., rounds one and two) and then the first two turns in the next set of two rounds (e.g., rounds three and four).

In alternate embodiments, the random but fair mode can be further modified such that the control circuit 18 considers three or more rounds of play when making random but fair selections. If three rounds of play are used for four players, one player might have to wait up to eighteen turns between their own turns but may be awarded up to six consecutive turns. If the number of players was increased to eight, then the maximum number of turns that one of the players might have to wait between their own turns increases to forty-two. The more rounds that are simultaneously considered or bunched together by the control circuit 18, the more the random but fair process approaches true randomness.

In one embodiment, the random but fair mode undergoes a round shift during game play. As soon as all players have received one turn, a new round of turns is added. For example, and referring to FIG. 6, as soon as player B is selected at the beginning of round two, each of the players has had one turn. Players A, C, and D were already given a turn in round one. Because each of the players has had one turn, a new round of turns, which would be round five, is added and round one drops off. Even so, the control circuit 18 keeps track of the fact that players A, D, and B have had one turn each and player C has already had two turns.

In a similar embodiment, the random but fair mode continually scrolls turns during game play to redefine the rounds. As soon as a player receives a turn, each of the rounds shift over one turn. For example, and still referring to FIG. 6, after player C is selected first in round one, the rounds would each shift one turn to the right. The first turn in round one where player C was selected falls off and is replaced by a new turn at the end of round four. As a result, and using FIG. 6 for the purposes of illustration, round one would be reconstituted to include the turns of players C, D, A, and B in that order, round two would be redefined to include the turns of players D, A, B, and A in that order, and so on and so forth. Each time a new turn is awarded, the entire line scrolls one turn to the right as oriented in FIG. 6 and a new turn is added at the end to compensate for the turn that was just awarded.

From the foregoing, those skilled in the art will recognize that the game selection device 10 selectively produces a sequential, random, or random but fair order of turns for use during a variety of different multiple player games. Therefore, the order of turns need not be monitored during games where players are provided turns in sequential order. Moreover, the device 10 is able to conveniently generate random turns to add excitement to games normally played with a consecutive order of turns. Further, the device 10 can provide a random but fair aspect to games to maintain excitement yet keep all players on a somewhat level playing field.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A game player selection device for indicating a turn in a multiple player game, comprising:

a housing;

a selector positioned on the housing to allow selection of one of a plurality of operating modes;

a plurality of indicators dispersed on the housing; and a control circuit operably coupled to the selector and the plurality of indicators, the control circuit temporarily activating at least one of the indicators based on a selected one of the plurality of operating modes to indicate the turn, wherein the plurality of operating modes includes a random but fair mode.

2. The game player selection device of claim 1, wherein the plurality of operating modes includes a sequential mode and a random mode.

3. The game player selection device of claim 1, wherein the plurality of indicators are formed from light emitting diodes (LEDs).

4. The game player selection device of claim 1, wherein the control circuit simultaneously illuminates two or more of the plurality of indicators.

5. The game player selection device of claim 1, wherein the indicators are positioned on the housing to provide a directional indication corresponding to a seating position of game players.

6. The game player selection device of claim 1, wherein the plurality of indicators includes two to eight indicators.

7. The game player selection device of claim 1, wherein the control circuit is a microcontroller.

8. The game player selection device of claim 1, wherein the indicators are depressible to input a desired number of players into the control circuit.

9. The game player selection device of claim 1, wherein the control circuit determines a number of players based on user manipulation of the selector.

10. The game player selection device of claim 1, wherein at least one of the plurality of indicators has a different color than another of the plurality of indicators.

11. A method of identifying player turns in a multiple player game using a player selection device, the method comprising the steps of:

providing a player selection device;

selecting one of a plurality of operating modes made available by the player selection device, wherein the plurality of operating modes includes a random but fair mode;

indicating by the player selection device an initial one of the player turns based on the selected operating mode; and indicating by the player selection device a next one of the player turns based on the selected operating mode.

12. The method of claim 11, wherein the method further comprises the step of inputting the number of players into the player selection device.

13. The method of claim 11, wherein the plurality of operating modes further includes one or more of a sequential mode and a random mode.

14. The method of claim 11, wherein the method comprises repeating the step of indicating a next one of the player turns.

15. The method of claim 11, wherein a visual indication is provided by the step of indicating the initial one and by the step of indicating the next one.

16. The method of claim 11, wherein the method further comprises the step of adding at least one additional player during game play.

17. The method of claim 11, wherein the method further comprises the step of removing a current player during game play.

18. A method of playing a game using a game player selection device according to a random but fair process, the method comprising the steps of:

providing the game player selection device;

inputting a number of players in the game into the game player selection device;

inputting a number of rounds to be considered into the game player selection device;

determining by the game player selection device available turns from the number of players and the number of rounds;

designating by the game player selection device a turn limit to each of the number of players in the game based on the number of rounds;

initiating the game by operating the game player selection device;

randomly providing a selected one of the number of players with one of the available turns;

taking a turn by the player that was randomly selected;

decrementing the number of available turns from the player that just completed the turn;

removing the selected one from consideration for further of the available turns when the selected one has reached the turn limit; and repeating the randomly providing, decrementing, and removing steps until the available turns are exhausted such that the game is played according to the random but fair process.

19. The method of claim 18, wherein the method further comprises the steps of adding at least one additional player during the game and adjusting both the designated turn limit and the available turns to incorporate the additional player into the game.

20. The method of claim 18, wherein the method further comprises the steps of removing at least one current player during the game and adjusting both the designated turn limit and the available turns to extract the current player from the game.

* * * * *